United States Patent [19]

Atkins et al.

[11] 3,988,646

[45] Oct. 26, 1976

[54] IGNITION DEVICES

[75] Inventors: Francis James Atkins; Ian Albert Fisher, both of Leamington Spa, England

[73] Assignee: Associated Engineering Limited, England

[22] Filed: Nov. 20, 1974

[21] Appl. No.: 525,457

[30] Foreign Application Priority Data

Nov. 29, 1973 United Kingdom ..... 55443/73

[52] U.S. Cl. ..... 317/96; 313/141

[51] Int. Cl.[2] ..... H01T 13/46

[58] Field of Search ... 317/96; 123/143 B, 169 MG; 313/128, 139, 140, 141, 142, 143

[56] References Cited

UNITED STATES PATENTS

| | | | |
|---|---|---|---|
| 1,148,106 | 7/1915 | Lux | 313/139 |
| 1,177,043 | 3/1916 | McLaughlin | 313/128 |
| 3,312,848 | 4/1967 | Baum | 313/139 |
| 3,842,818 | 10/1974 | Cowell | 123/169 MG |
| 3,842,819 | 10/1974 | Atkins | 123/169 MG |

*Primary Examiner*—J. V. Truhe
*Assistant Examiner*—Clifford C. Shaw
*Attorney, Agent, or Firm*—Brisebois

[57] ABSTRACT

An ignition device for igniting a gaseous medium, such as a fuel/air mixture, comprises a chamber having a wall provided with an aperture through which the chamber can be placed in communication with the medium to be ignited, a first electrode extending across said chamber to said aperture to define an annular gap between the tip of said first electrode and the wall of said aperture, which wall forms at least part of a second electrode, and a third electrode surrounding and insulated from said first electrode and defining a second gap within said chamber between said third electrode and one of said first and second electrodes.

5 Claims, 3 Drawing Figures

IGNITION DEVICES

The present invention relates to ignition devices.

From one aspect the invention provides an ignition device comprising a chamber having a wall provided with an aperture through which the chamber can be placed in communication with a medium to be ignited, a first electrode extending across said chamber to said aperture to define an annular gap between the tip of said first electrode and the wall of said aperture, which wall forms at least part of a second electrode, and a third electrode surrounding and insulated from said first electrode and defining a second gap within said chamber between said third electrode and one of said first and second electrodes.

The invention also provides an ignition device comprising a chamber having a wall provided with an aperture through which the chamber is in communication with a medium to be ignited and means to produce a plasma flame which projects through said aperture to ignite said medium, said means including a first electrode extending across said chamber to said aperture to define an annular gap between the tip of said first electrode and the wall of said aperture, which wall forms at least part of a second electrode, said first and second electrodes being adapted to receive a first potential across them which is insufficient by itself to cause electrical breakdown of said annular gap and a third electrode surrounding said first electrode and defining a second gap between itself and one of said first and second electrodes, said second gap being adapted to receive a second higher potential across said second gap thereby to cause a first potential applied to said first and second electrode to discharge across said annular gap.

The invention will now be described further, by way of example, with reference to the accompanying drawings, in which.

Figure 1:
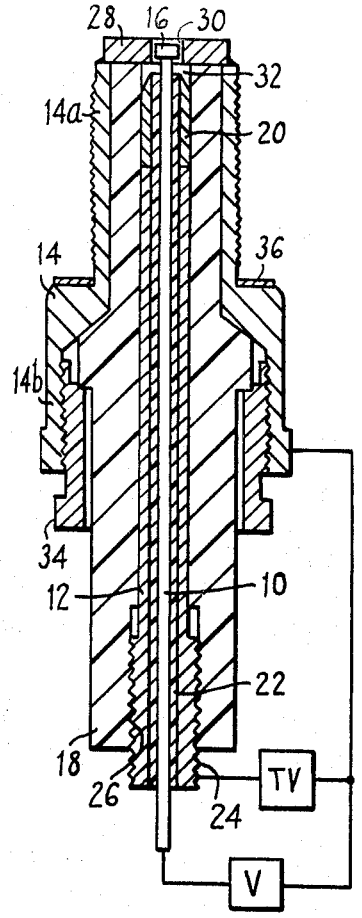
FIG. 1 is a diagrammatic cross-sectional view of one embodiment of ignition device according to the invention.
Figure 2:
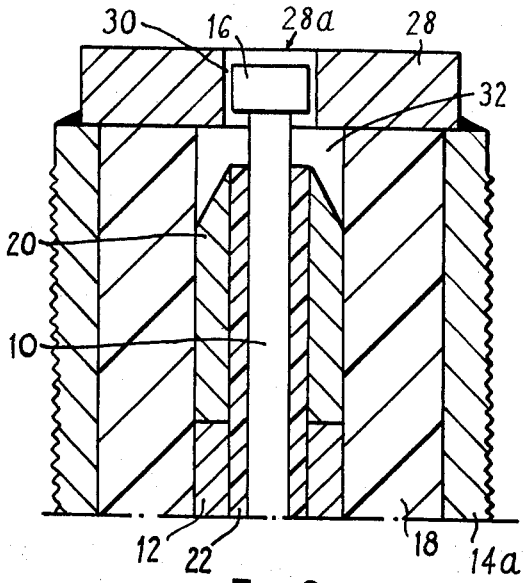
FIG. 2 is a scrap view of part of the ignition device of FIG. 1 on a larger scale.

Referring to FIGS. 1 and 2, the ignition device illustrated consists of a central rod electrode 10 surrounded by coaxial cylindrical electrodes 12 and 14. The electrodes are respectively separated by bodies of insulating material 22 and 18. Electrode tips 16, 20, 28 are fixed to the electrodes 10, 12 and 14 respectively. A chamber 32 is located at the top of the device, as viewed in FIGS. 1 and 2, and is mainly defined by the inner surface of insulating body 18 and the tips 20 and 28 of electrodes 12 and 14. The central rod electrode 10 extends through the chamber and its tip 16, in the form of an enlarged head, is located in a hole **28*a* in the disc-like tip 28 of the electrode 14. Thus, an annular gap 30 is defined between the electrode tips 16 and 28 and this gap enables communication between the chamber 32** and an external medium, for example a charge of fuel and air, to be ignited.

The central rod electrode 10 is made from a conductive material such as brass, copper or ferrous material, the electrode tip 16 being in the form of a cylindrical cap and made from a material resistant to erosion by electric discharges, such as silicon carbide or certain nickel alloys, (e.g. INCONEL 600SP). The insulating material 18 and 22 is silicon nitride or alumina ceramic.

The electrode 12 forms a trigger electrode and is made from brass, copper or a ferrous material, the electrode tip 20 being made from a nickel alloy (e.g. INCONEL 600SP). The tip tapers towards its free end. The other end of the trigger electrode 12 is screw threaded at 24 and is received within a cooperating screw thread 26 formed in the body of insulating material 18 extending around the trigger electrode.

The electrode 14 forms part of the external case of the ignition device and is made from a ferrous material, e.g. steel. The electrode tip 28, in the form of a disc, is again made from a nickel alloy (e.g. INCONEL 600SP). The narrower diameter portion **14*a* of the case receives the insulating material 22 as a snug fit and a sleeve-like locking nut 34 received within the wider diameter portion 14*b*** of the case serves to secure the inner components in position and form a gas-tight seal.

The external surface of the narrower diameter portion **14*a* is screw threaded to enable the device to be located in position, for example to be received in a spark plug aperture in a cylinder head of an internal combustion engine. If desired, a sealing washer 36** may be located on the outside of the case at the shoulder between the narrower and wider diameter portions.

In operation in an engine, a voltage which is not itself sufficient to break down the annular gap 30 is applied between the electrode tips 16 and 28 across this annular gap. The voltage originates from a D.C. voltage source V, which may be a capacitor charged to a D.C. voltage of e.g. 200 volts.

To create or initiate a discharge in the chamber 32, a trigger voltage from a trigger voltage source TV is applied between the electrode tips 20 and 28. Where the ignition device is used for igniting the fuel/air charge of an internal combustion engine, the trigger voltage can conveniently be derived from the vehicle ignition coil and distributor and may have a value of 10 KV or more. The trigger voltage creates a spark across the chamber 32 which at least partly ionises the gas therein. This reduces the breakdown potential between the electrode tips 16 and 28 thus allowing the voltage V to create a relatively low voltage, high current discharge. This discharge creates a high temperature arc plasma in the restricted annular gap 30 and the resultant increase in pressure in the chamber 32 forces the plasma through the gap 30 into the combustion space of the engine. The gap 30 has the effect of moulding the plasma into a jet which is used to ignite the fuel/air charge in the engine combustion space.

Since the voltage V is applied from a capacitor, which discharges relatively rapidly, the voltage applied across the electrodes 10, 14 falls rapidly below a sustaining value so that the discharge is extinguished. The capacitor may then be recharged, for example from a power supply powered by a vehicle battery, to sustain a further discharge when a further fuel/air charge is present in the engine combustion space.

As explained above, the main discharge occurs across the annular gap 30 between the electrode tips 16 and 28. This annular gap is at least partially self-compensating for wear since, if a discharge at one point around the gap increases the radial distance between the two electrode tips, the next discharge will tend to take place at another point around the annular gap where the distance between the electrode tips is smaller. The position of the main discharge around the annulus also depends on where the trigger discharge occurs between the electrode tips 20 and 28, but it has been found that the annular gap is largely self-compensating in the sense that wear tends to take place evenly around the circumference.

After a period of time, the end face of the electrode tip 20 becomes worn and this tends to impair initiation of a spark. When this occurs the ignition device may be removed from the engine and the trigger electrode 12 screwed into the device to readjust the gap. This is achieved by screwing in the trigger electrode 12 (and hence electrode 10) on the threads 24 and 26 until its electrode tip 20 touches the electrode tip 28. The position of the end face of electrode tip 16 relative to the front face of electrode tip 28 is then measured by means of a depth gauge. The trigger electrode 12 is then unscrewed until the depth gauge shows that a required predetermined gap has been achieved between electrode tips 20 and 28.

Since the annular gap 30 is of constant width, although the electrode tip 16 is moved axially within the electrode tip 28 the gap 30 remains unchanged by adjustment of the trigger electrode.

Whilst the means of adjustment has been described as cooperating screw-threaded parts, it will be apparent that other forms of adjustment for enabling the position of the electrode 12 to be axially displaced may be used. For example a simple sliding arrangement can be used in combination with a clamping or locking device. However, whichever form of adjustment is used, it is essential that the mechanism is gas-tight so that the gases in the combustion chamber cannot escape to atmosphere.

It will be apparent that whilst the electrodes 10 and 12 have been described as adjustable with respect to the electrode 14, the essential requirement is to enable the gap between the tips 20 and 28 of the electrodes 12 and 14 to be maintained. Accordingly the third electrode 12 alone could be movable.

Moreover whilst the electrodes 10, 12 and 14 have each been described as having an electrode tip attached thereto, the electrode tips are not essential and could therefore be dispensed with. In particular the electrode 10 may be a plain rod electrode without an enlarged head.

In an alternative embodiment of the invention (not shown) in addition to the electrode 12 being movable relative to the electrode 14, the electrodes 10 and 14 are movable one relative to the other. In this embodiment of the invention the aperture in the tip 28 of electrode 14 is made frusto-conical and the tip 16 of electrode 10 is tapered to cooperate with the frusto-conical surface. Hence, when for example the tip 16 is moved away from the frusto-conical surface, the annular orifice defined between them increases in dimension.

Figure 3:
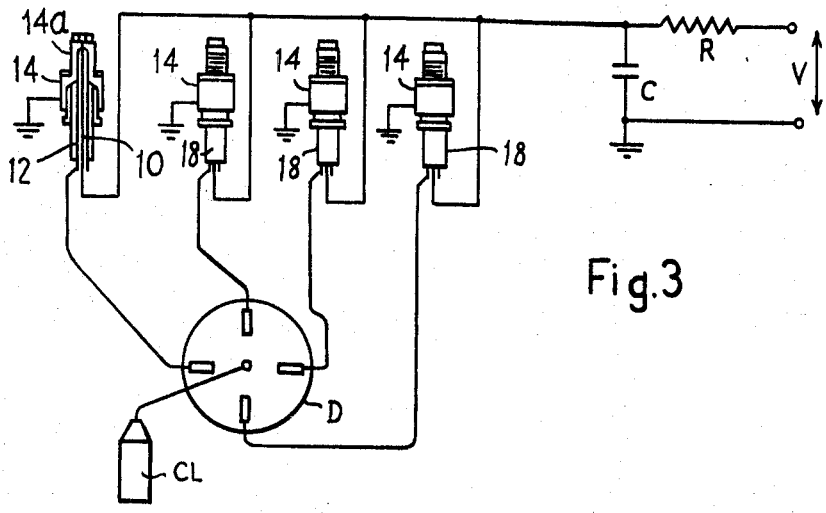
FIG. 3 is a circuit diagram illustrating the application of such ignition devices to a four-cylinder engine.

FIG. 3 shows a circuit diagram for providing timed ignition in a four-cylinder reciprocating internal combustion engine employing four ignition devices as shown in FIG. 1. The electrodes 14 are each connected to earth (i.e. to the chassis) and the electrodes 10 are each continuously connected to the high potential side of the capacitor C across which the D.C. voltage V is connected via the resistor R. This voltage V is obtained from a power supply fed, for example, from a vehicle battery. The trigger electrode 12 of each ignition device is connected through a distributor D, such as is conventionally used in ignition systems of motor vehicle internal combustion engines, to a coil CL for producing the very high voltage supply TV which forms the trigger voltage and which is distributed to the ignition devices in turn and in timed relationship with the operation of the internal combustion engine.

Whilst the ignition device has been particularly described as applied to the ignition of internal combustion engines in which the triggered discharge will be timed, it may also be used, for example, in gas turbine engines, oil-fired boilers and other devices which do not require a timed ignition, or in external combustion engines.

We claim:

1. An ignition device including first, second and third electrodes, a first body of insulating material surrounding said first electrode, said third electrode being disposed outside said first body of insulating material, a second body of insulating material surrounding said third electrode, said second electrode surrounding said second body of insulating material, said first, second and third electrodes and said first and second bodies together defining a chamber within the device, said second electrode having a part closing one end of said chamber and being formed with an orifice therethrough, said first electrode extending across said chamber and into said orifice thereby to define an annular gap between said first and second electrodes, a first source of electrical potential connected across said first and second electrodes, said potential being insufficient to cause electrical breakdown of said annular gap, and means including a second source of electrical potential at a substantially higher potential than said first source to apply said substantially higher potential between one of said first and second electrodes and said third electrode to create a spark across said chamber and at least partly ionise the gas therein, thereby reducing the breakdown potential between said first and second electrodes so that said first source of electrical potential creates a high-current discharge across the annular gap between said first and second electrodes, causing a high-temperature arc plasma in the annular gap, the resulting increase of pressure in the chamber causing the arc plasma to project from said gap.

2. An ignition device as claimed in claim 1, including means for adjusting the gap between said third electrode and said second electrode.

3. An ignition device as claimed in claim 2, wherein an assembly comprising the first and third electrodes is adjustable towards and away from said second electrode.

4. An ignition device as claimed in claim 1, wherein said first electrode has a cylindrical head extending into said orifice.

5. An ignition device as claimed in claim 1, wherein said first electrode is of rod-like form.

* * * * *